US006340026B1

(12) United States Patent
Shapiro

(10) Patent No.: US 6,340,026 B1
(45) Date of Patent: Jan. 22, 2002

(54) CARING DEVICE FOR TOES

(76) Inventor: Ada Shapiro, 92 Candy La., Syosset, NY (US) 11791

( * ) Notice: Subject to any disclaimer, the term of this patent is extended or adjusted under 35 U.S.C. 154(b) by 0 days.

(21) Appl. No.: 09/688,911

(22) Filed: Oct. 16, 2000

(51) Int. Cl.[7] ..... A45D 29/00
(52) U.S. Cl. ..... 132/73
(58) Field of Search ..... 132/73, 246, 247, 132/321, 275, 274; 15/222; 601/137, 138; 228/56, 57, 63; 2/279, 171; 24/17 B

(56) References Cited

U.S. PATENT DOCUMENTS

| | | | | | |
|---|---|---|---|---|---|
| 1,208,064 | A | * | 12/1916 | Wilber | 15/222 |
| 1,922,169 | A | | 8/1933 | Martin | 28/1 |
| 2,329,676 | A | * | 9/1943 | Henry | 132/274 |
| 3,005,543 | A | * | 10/1961 | Morse | 132/73 |
| 3,490,453 | A | | 1/1970 | Ogden | 128/260 |
| 3,542,041 | A | * | 11/1970 | Mercorella | 132/273 |
| 3,812,849 | A | | 5/1974 | Giunta | 128/67 |
| 3,882,868 | A | | 5/1975 | Tundermann | 128/260 |
| 3,943,922 | A | | 3/1976 | Umeda | 128/81 R |
| 3,977,796 | A | | 8/1976 | Gillespie et al. | 401/8 |
| 4,187,575 | A | | 2/1980 | Collins | 15/222 |
| 4,343,061 | A | * | 8/1982 | Hanazono | 15/222 |
| 4,723,325 | A | * | 2/1988 | Perry | 2/279 |
| 4,761,849 | A | * | 8/1988 | Taylor | 15/222 |
| 4,877,018 | A | | 10/1989 | Ikebe et al. | 128/81 R |
| 4,885,824 | A | * | 12/1989 | Schwab et al. | 24/17 B |
| 5,401,550 | A | * | 3/1995 | Hannon | 15/222 |
| 5,504,963 | A | * | 4/1996 | Bynum et al. | 15/222 |
| 5,655,224 | A | * | 8/1997 | Sears | 132/273 |
| 5,694,955 | A | * | 12/1997 | Grooms | 132/247 |

* cited by examiner

*Primary Examiner*—Todd E. Manahan
(74) *Attorney, Agent, or Firm*—Richard L. Miller, P.L.

(57) ABSTRACT

A caring device for toes that includes a body and a pair of handles. The body is either tubular, flat, solid, or a sheet of rolled material for moving longitudinally between a pair of adjacent toes or is an endless loop for moving longitudinally and simultaneously between two pair of adjacent toes. The body is made of either cheesecloth, disposable paper, stockinet, or 100% cotton, is seamless and braidless for obviating risk of scarification of the toes caused by seams and braids when the body is moved between the toes during use, and is either dry for drying the toes so as to prevent formation of athlete's foot and other skin irritations and odors originating from moisture or is impregnated with a medicinal powder or cream for preventing at least skin cracking, infection, and fungus. Each handle is either a ring that is attached to the body by either the associated free end of the body being knotted or stitched therearound or has the endless loop pass therethrough or is an associated free end of the body formed into fringes that are knotted to prevent unraveling of the body and for providing grasping portions that prevent the fringes from slipping through the hands. The fringes supplement the grasping portions of the knots by shifting accordingly and filling any gaps between the knots and the hand so as to provide a more contiguous grasping surface. The ring is rigid and cordless for facilitating grasping thereof by the hands, as opposed to a cord which would collapse onto itself.

16 Claims, 1 Drawing Sheet

FIG. 1
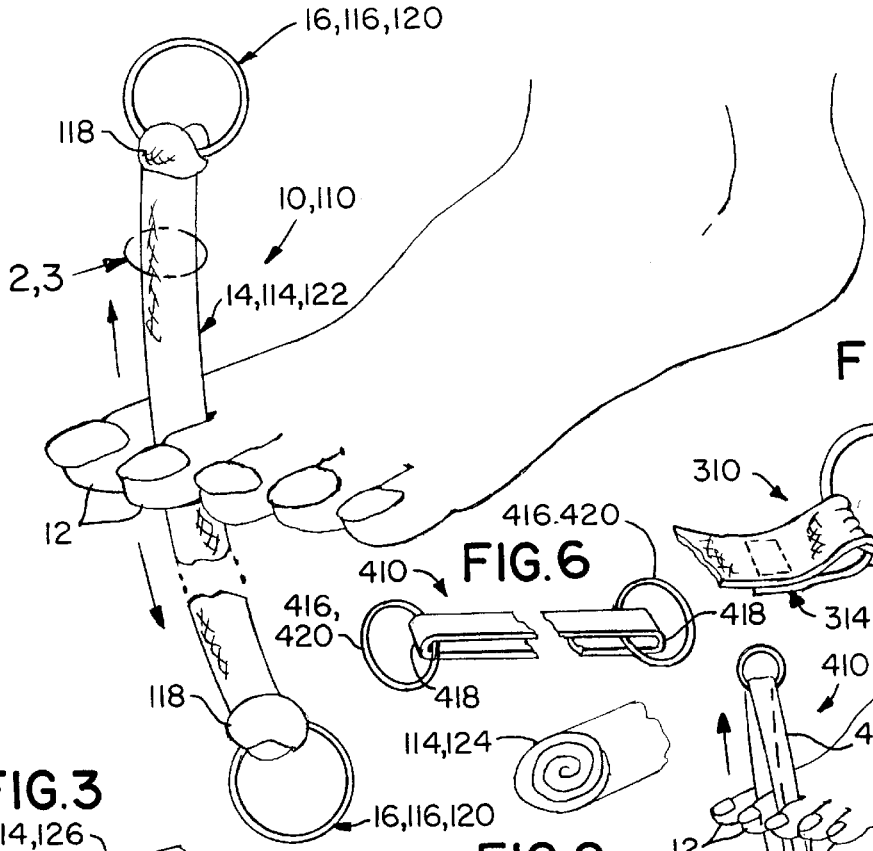
FIG.5
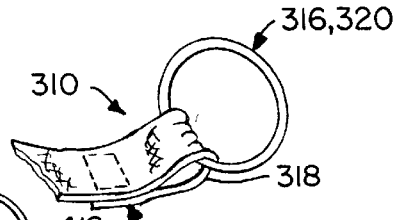
FIG.6
FIG.6A
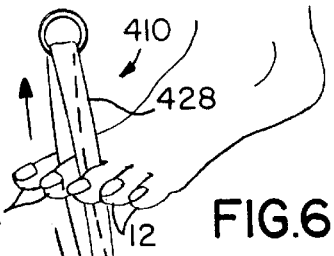
FIG.3
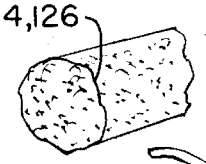
FIG.2
FIG.4
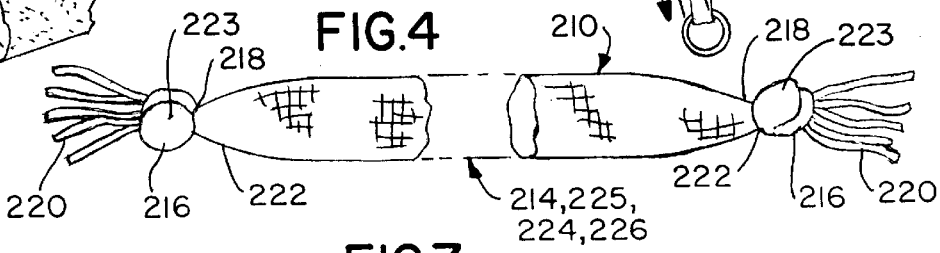
FIG.7
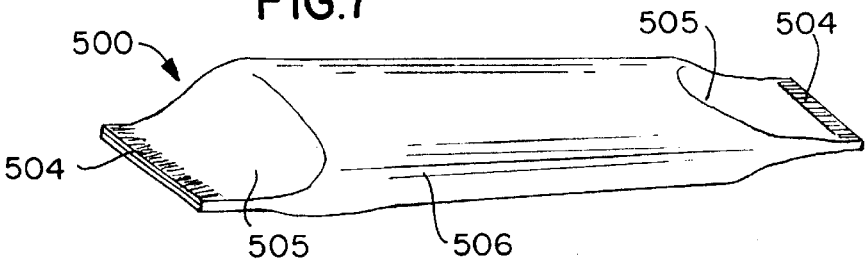

CARING DEVICE FOR TOES

BACKGROUND OF THE INVENTION

1. Field of the Invention:

The present invention relates to a caring device. More particularly, the present invention relates to a caring device for toes.

2. Description of the Prior Art:

Numerous innovations for body caring devices have been provided in the prior art that will be described. Even though these innovations may be suitable for the specific individual purposes to which they address, however, they differ from the present invention.

A FIRST EXAMPLE, U.S. Pat. No. 1,922,169 to Martin teaches the combination of a towel, a cord embedded in and enclosed by the fabric of the towel and projecting beyond each end of the towel to form handles.

A SECOND EXAMPLE, U.S. Pat. No. 3,490,453 to Ogden teaches a foot apparatus and, more particularly, to an elongated member formed of resilient foam and suitably impregnated with medicinal substance for being interlaced between the toes of the human foot.

A THIRD EXAMPLE, U.S. Pat. No. 3,812,849 to Guinta teaches a skin conditioning article that has a springy and pliable body of layers of nylon net fabric with a mesh of about one-eighth inch, more or less. In the illustrated embodiment, the body is elongated and has four layers of fabric gathered at either end to form necks and pleats. The fabric is first doubled upon itself to form a folded end edge. Both sides of the fabric are then doubled over to form a pair of folded side edges and open edges proximate each other at the center of one face of the body. The layers are secured to each other in any suitable manner, as by stitching, proximate each of the opposite ends of the body, and this stitching may also secure ties to the body for gathering the layers and forming the pleats and necks. The open edges of the body, layers provide access to a pocket, formed by the folded end edge of the body, for retaining a bar of soap or other suitable article. The skin may be lubricated and the net fabric rubbed over the skin to cleanse and condition the skin.

A FOURTH EXAMPLE, U.S. Pat. No. 3,882,868 to Tundermann teaches a disposable foot-care article in the form of a toe cover made of absorbent non-woven fabric or suitable stock, and method of manufacturing same that utilizes a continuous web wherein the web is impregnated with medicated foot-care agents, folded longitudinally into at least a partial overlap and then sealed and cut diagonally to produce a slipper-shaped toe cover.

A FIFTH EXAMPLE, U.S. Pat. No. 3,943,922 to Umeda teaches a drying appliance for preventing athlete's foot, which is attached to the underside of the human toes and can absorb the moist, greasy and other secretions existing on the toes, on which a medicament can be applied and/or permeated.

A SIXTH EXAMPLE, U.S. Pat. No. 3,977,796 to Gillespie et al. teaches two pieces of nylon net of predetermined dimensions that are superimposed on a piece of terry cloth of the pre-determined dimensions. The terry cloth and nylon combination is folded over on itself to form a strip-like configuration in a manner whereby the net is on the outside. Each of a pair of handle members is affixed to a corresponding end of the strip-like configuration of terry cloth and nylon.

A SEVENTH EXAMPLE, U.S. Pat. No. 4,187,575 to Collins teaches a combination hand washer and back scrubber, comprising an elongated strip of fabric, having two lateral edges, transverse, expansible strips attached to a first side of said fabric strip, each transverse strip extending substantially the entire width of said fabric strip, said transverse, expansible strips including sponge strips and abrasive strips aligned on said first side in an alternating manner, a water absorbent strip attached to an opposite second side of said fabric strip, said water absorbent strip being non-abrasive to skin, and a transverse elastic hand strap of elongated dimension, attached at opposite ends to said respective lateral edges of said fabric strip at approximately the midpoints thereof to form a loop for retaining said fabric strip in a folded position and for allowing the hand of a person to fit within said loop to use said combination hand washer and back scrubber as a wash cloth.

AN EIGHTH EXAMPLE, U.S. Pat. No. 4,877,018 to Ikebe et al. teaches a device for deodorizing and drying a portion between toes used by putting it between toes. The device comprises two rod-shaped flexible fibrous elements or layers formed of a large number of fibers disposed parallel to the longitudinal axis of said layers, an air- and water-permeable flexible shell member being wound around said flexible fibrous layers such that a cavity is formed between the upper fibrous layer and the lower fibrous layer, and particulate substances having a hygroscopic function being housed in said cavity in a quantity corresponding to a part of a volume of said cavity.

It is apparent that numerous innovations for body caring devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a caring device for toes that avoids the disadvantages of the prior art.

ANOTHER OBJECT of the present Invention is to provide a caring device for toes that is simple and inexpensive to manufacture.

STILL ANOTHER OBJECT of the present invention is to provide a caring device for toes that is simple to use.

BRIEFLY STATED, STILL YET ANOTHER OBJECT of the present invention is to provide a caring device for toes that includes a body and a pair of handles. The body is either tubular, flat, solid, or a sheet of rolled material for moving longitudinally between a pair of adjacent toes or is an endless loop for moving longitudinally and simultaneously between two pair of adjacent toes. The body is made of either cheesecloth, disposable paper, stockinet, or 100% cotton, is seamless and braidless for obviating risk of scarification of the toes caused by seams and braids when the body is moved between the toes during use, and is either dry for drying the toes so as to prevent formation of athlete's foot and other skin irritation sand odors originating from moisture or is impregnated with a medicinal powder or cream for preventing at least skin cracking, infection, and fungus. Each handle is either a ring that is attached to the body by either the associated free end of the body being knotted or stitched therearound or has the endless loop pass therethrough or is an associated free end of the body formed into fringes that are knotted to prevent unraveling of the body and for providing grasping portions that prevent the fringes from slipping through the hands. The fringes supplement the grasping portions of the knots by shifting accordingly and filling any gaps between the knots and the hand so as to provide a more contiguous grasping surface. The ring is rigid and cordless for facilitating grasping thereof by the hands, as opposed to a cord which would collapse onto itself.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of a first embodiment of the present invention in use;

FIG. 2 is a diagrammatic perspective view of the area generally enclosed by the dotted curve identified by arrow 2 in FIG. 1;

FIG. 3 is a diagrammatic perspective view of the area generally enclosed by the dotted curve identified by arrow 3 in FIG. 1;

1 FIG. 4 is a diagrammatic perspective view of a second embodiment of the present invention;

FIG. 5 is a diagrammatic perspective view of a third embodiment of the present invention;

FIG. 6 is a diagrammatic perspective view of a fourth embodiment of the present invention;

FIG. 6A is a diagrammatic perspective view of the fourth embodiment of the present invention in use; and FIG. 7 is a diagrammatic perspective view of a case of the present invention.

LIST OF REFERENCE NUMERALS UTILIZED IN THE DRAWING

General

10 caring device of present invention for toes 12
12 toes
14 body for moving longitudinally and simultaneously between least one pair of adjacent toes 12
16 pair of handles for holding by hands during use

First Embodiment

110 caring device of present invention for toes 12
114 body for moving longitudinally between one pair of adjacent toes 12
116 pair of handles
118 free ends of body 114
120 ring of each handle of pair of handles 116
122 tube of body 114
124 sheet of rolled material of body 114
126 solid of body 114

Second Embodiment

210 caring device of present invention for toes 12
214 body for moving longitudinally between one pair of adjacent toes 12
216 pair of handles
218 pair of free ends of body 214
220 fringes of associated free end of pair of free ends 218 of body 214 for supplementing grasping portions of knots 223 at origination point 222 of fringes 220 of associated free end of pair of free ends 218 of body 214 by shifting accordingly and filling any gaps between knots 223 at origination point 222 of fringes 220 of associated free end of pair of free ends 218 of body 214 and hand so as to provide more contiguous grasping surface
222 origination point of fringes 220 of associated free end of pair of free ends 218 of body 214
223 knot at origination point 222 of fringes 220 of associated free end of pair of free ends 218 of body 214 for providing grasping portions that prevent fringes 220 from slipping through hands
224 sheet of rolled material of body 214
225 tube of body 214
226 solid of body 214

Third Embodiment

310 caring device of present invention for toes 12
314 body
316 pair of handles
318 pair of free ends of flat body 328 of body 314
320 ring of each handle of pair of handles 316
328 flat body of body 314 for moving longitudinally between one pair of adjacent toes 12

Fourth Embodiment

410 caring device of present invention for toes 12
414 body
416 pair of handles
418 pair of opposing extremes of endless loop 428 of body 414
420 ring of each handle of pair of handles 416
428 endless loop of body 414 for moving longitudinally and simultaneously between two pair of adjacent toes 12 by capturing intermediate toe 12 therein

Package

500 package
504 pair of ends of package 500
505 opposing ends of intermediate portion 506 of package 500
506 intermediate portion of package 500

DETAILED DESCRIPTION OF THE PREFERRED EMBODIMENT

Referring now to the figures, in which like numerals indicate like parts, and particularly to FIG. 1, the caring device of the present invention is shown generally at 10 for toes 12.

The general configuration of the caring device 10 can best be seen in FIG. 1, and as such, will be discussed with reference thereto.

The caring device 10 comprises a body 14 for moving longitudinally and simultaneously between at least one pair of adjacent toes 12 and has a length, and a pair of handle 16 that extend from the body 14 for holding by the hands during use.

The specific configuration of a first embodiment of the caring device 110 can best be seen in FIGS. 1–3, and ad such, will be discussed with reference thereto.

As shown in FIG. 1, the body 114 is slender and elongated for moving longitudinally between one pair of adjacent toes 12, and has a pair of free ends 118.

As shown in FIG. 1, each handle 116 is a ring 120 that is attached to an associated free end 118 of the body 114 by the associated free end 118 of the body 114 being knotted therearound so as to allow each ring 120 to slide in the associated free end 118 of the body 114.

The ring 120 is rigid and cordless so as to facilitate the ring 120 in sliding in the associated free end 118 of the body 114 and for facilitating grasping thereof by the hands, as opposed to a cord which would collapse onto itself.

As shown in FIG. 1, the body 114 is tubular so as to form a tube 122.

The tube 122 is made from cheesecloth.

The tube 122 is made from disposable paper.

The tube 122 is made from stockinet which is resiliently stretchable for easy insertion between the toes 12 by virtue of being reduced in width when longitudinally stretched.

The tube 122 is made from 100% cotton.

The tube 122 is seamless for obviating risk of scarification of the toes 12, which are by nature extremely tender and sensitive, caused by seams, which are by nature relatively hard and abrasive, when the tube 122 is moved between the toes 12 during use.

The tube 122 is braidless for obviating risk of scarification of the toes 12, which are by nature extremely tender and sensitive, caused by braids, which are by nature relatively hard and abrasive, when the tube 122 is moved between the toes 12 during use.

The tube 122 is dry for drying the toes 12 so as to prevent formation of athlete's foot and other skin irritations and odors originating from moisture and to aid the handicapped in keeping the toes 12 dry.

The tube 122 is impregnated with medicinal powder for preventing at least skin cracking, infection, and fungus.

The tube 122 is impregnated with medicinal cream for preventing at least skin cracking, infection, and fungus.

As shown in FIG. 2, the body 114 is made from a sheet of material rolled upon itself so as to form a sheet of rolled material 124.

The sheet of rolled material 124 is made from cheesecloth.

The sheet of rolled material 124 is made from disposable paper.

The sheet of rolled material 124 is made from stockinet which is resiliently stretchable for easy insertion between the toes 12 by virtue of being reduced in width when longitudinally stretched.

The sheet of rolled material 124 is made from 100% cotton.

The sheet of rolled material 124 is seamless for obviating risk of scarification of the toes 12, which are by nature extremely tender and sensitive, caused by seams, which are by nature relatively hard and abrasive, when the sheet of rolled material 124 is moved between the toes 12 during use.

the sheet of rolled material 124 is braidless for obviating risk of scarification of the toes 12, which are by nature extremely tender and sensitive, caused by braids, which are by nature relatively hard and abrasive, when the sheet of rolled material 124 is moved between the toes 12 during use.

The sheet of rolled material 124 is dry for drying the toes 12 so as to prevent formation of athlete's foot and other skin irritations and odors originating from moisture and to aid the handicapped in keeping the toes 12 dry.

The sheet of rolled material 124 is impregnated with medicinal powder for preventing at least skin cracking, infection, and fungus.

The sheet of rolled material 124 is impregnated with medicinal cream for preventing at least skin cracking, infection, and fungus.

As shown in FIG. 3, the body 114 is a solid material so as to form a solid 126.

The solid 126 is made from cheesecloth.

The solid 126 is made from disposable paper.

The solid 126 is made from stockinet which is resiliently stretchable for easy insertion between the toes 12 by virtue of being reduced in width when longitudinally stretched.

The solid 126 is made from 100% cotton.

The solid 126 is seamless for obviating risk of scarification of the toes 12, which are by nature extremely tender and sensitive, caused by seams, which are by nature relatively hard and abrasive, when the solid 126 is moved between the toes 12 during use.

The solid 126 is braidless for obviating risk of scarification of the toes 12, which are by nature extremely tender and sensitive, caused by braids, which are by nature relatively hard and abrasive, when the solid 126 is moved between the toes 12 during use.

The solid 126 is dry for drying the toes 12 so as to prevent formation of athlete's foot and other skin irritations and odors originating from moisture and to aid the handicapped in keeping the toes 12 dry.

The solid 126 is impregnated with medicinal powder for preventing at least skin cracking, infection, and fungus.

The solid 126 is impregnated with medicinal cream for preventing at least skin cracking, infection, and fungus.

The specific configuration of a second embodiment of the caring device 210 can best be seen in FIG. 4, and as such, will be discussed with reference thereto.

The body 214 is slender and elongated for moving longitudinally between one pair of adjacent toes 12, and has a pair of free ends 218.

Each handle 216 is an associated free end 218 of the body 214 formed into fringes 220 that has an origination point 222 that is knotted by a knot 223 to prevent unraveling of the body 214 and for providing grasping portions that prevent the fringes 220 from slipping through the hands.

The fringes 220 supplement the grasping portions of the knots 223 by shifting accordingly and filling any gaps between the knots 223 and the hand so as to provide a more contiguous grasping surface.

The body 214 is tubular so as to form a tube 225.

The tube 225 is made from cheesecloth.

The tube 225 is made from disposable paper.

The tube 225 is made from stockinet which is resiliently stretchable for easy insertion between the toes 12 by virtue of being reduced in width when longitudinally stretched.

The tube 225 is made from 100% cotton.

The tube 225 is seamless for obviating risk of scarification of the toes 12, which are by nature extremely tender and sensitive caused by seams, which are by nature relatively hard and abrasive, when the tube 225 is moved between the toes 12 during use.

The tube 225 is braidless for obviating risk of scarification of the toes 12, which are by nature extremely tender and sensitive, caused by braids, which are by nature relatively hard and abrasive, when the tube 225 is moved between the toes 12 during use.

The tube 225 is dry for drying the toes 12 so as to prevent formation of athlete's foot and other skin irritations and odors originating from moisture and to aid the handicapped in keeping the toes 12 dry.

The tube 225 is impregnated with medicinal powder for preventing at least skin cracking, infection, and fungus.

The tube 225 is impregnated with medicinal cream for preventing at least skin cracking, infection, and fungus.

The body 214 is made from a sheet of material rolled upon itself so as to form a sheet of rolled material 224.

The sheet of rolled material 224 is made from cheesecloth.

The sheet of rolled material 224 is made from disposable paper.

The sheet of rolled material 224 is made from stockinet which is resiliently stretchable for easy insertion between the toes 12 by virtue of being reduced in width when longitudinally stretched.

The sheet of rolled material 224 is made from 100% cotton.

The sheet of rolled material 224 is seamless for obviating risk of scarification of the toes 12, which are by nature extremely tender and sensitive, caused by seams, which by nature are relatively hard and abrasive, when the sheet of rolled material 224 is moved between the toes 12 during use.

The sheet of rolled material 224 is braidless for obviating risk of scarification of the toes 12, which are by nature extremely tender and sensitive, caused by braids, which are by nature relatively hard and abrasive, when the sheet of rolled material 224 is moved between the toes 12 during use.

The sheet of rolled material 224 is dry for drying the toes 12 so as to prevent formation of athlete's foot and other skin irritations and odors originating from moisture and to aid the handicapped in keeping the toes 12 dry.

The sheet of rolled material 224 is impregnated with medicinal powder for preventing at least skin cracking, infection, and fungus.

The sheet of rolled material 224 is impregnated with medicinal cream for preventing at least skin cracking, infection, and fungus.

The body 214 is a solid material so as to form a solid 226.

The solid 226 is made from cheesecloth.

The solid 226 is made from disposable paper.

The solid 226 is made from stockinet which is resiliently stretchable for easy insertion between the toes 12 by virtue of being reduced in width when longitudinally stretched.

The solid 226 is made from 100% cotton.

The solid 226 is seamless for obviating risk of scarification of the toes 12, which are by nature extremely tender and sensitive, caused by seams, which by nature are relatively hard and abrasive, when the solid 226 is moved between the toes 12 during use.

The solid 226 is braidless for obviating risk of scarification of the toes 12, which are by nature extremely tender and sensitive, caused by braids, which are by nature relatively hard and abrasive, when the solid 226 is moved between the toes 12 during use.

The solid 226 is dry for drying the toes 12 so as to prevent formation of athlete's foot and other skin irritations and odors originating from moisture and to aid the handicapped in keeping the toes 12 dry.

The solid 226 is impregnated with medicinal powder for preventing at least skin cracking, infection, and fungus.

The solid 226 is impregnated with medicinal cream for preventing at least skin cracking, infection, and fungus.

The specific configuration of a third embodiment of the caring device 310 can best be seen in FIG. 5, and as such, will be discussed with reference thereto.

The body 314 is slender, elongated, and flat so as to form a flat body 328 for moving longitudinally between one pair of adjacent toes 12, and has a pair of free ends 318.

Each handle 316 is a ring 320 that is attached to an associated free end 318 of the flat body 328 by the associated free end 318 of the flat body 328 passing therethrough, and doubling back unto itself, where it is stitched to itself so as to allow each ring 320 to slide in the associated end free 318 of the flat body 328.

The ring 320 is rigid and cordless so as to facilitate the ring 320 in sliding in the associated free end 318 of the body 314 and for facilitating grasping thereof by the hands, as opposed to a cord which would collapse onto itself.

The flat body 328 is made from cheesecloth.

The flat body 328 is made from disposable paper.

The flat body 328 is made from stockinet which is resiliently stretchable for easy insertion between the toes 12 by virtue of being reduced in width when longitudinally stretched.

The flat body 328 is made from 100% cotton.

The flat body 328 is seamless for obviating risk of scarification of the toes 12, which are by nature extremely tender and sensitive, caused by seams, which by nature are relatively hard and abrasive, when the flat body 328 is moved between the toes 12 during use.

The flat body 328 is braidless for obviating risk of scarification of the toes 12, which are by nature extremely tender and sensitive, caused by braids, which by nature are relatively hard and abrasive, when the flat body 328 is moved between the toes 12 during use.

The flat body 328 is dry for drying the toes 12 so as to prevent formation of athlete's foot and other skin irritations and odors originating from moisture and to aid the handicapped in keeping the toes 12 dry.

The flat body 328 is impregnated with medicinal powder for preventing at least skin cracking, infection, and fungus.

The flat body 328 is impregnated with medicinal cream for preventing at least skin cracking, infection, and fungus.

The specific configuration of a fourth embodiment of the caring device 410 can best be seen in FIGS. 6 and 6A, and as such, will be discussed with reference thereto.

The body 414 is slender, elongated, flat, and formed into an endless loop 428 for moving longitudinally and simultaneously between two pair of adjacent toes 12 by capturing an intermediate toe 12 therein, and has a pair of opposing extremes 418.

Each handle 416 is a ring 420 that has the endless loop 428 pass freely therethrough so as to allow each ring 420 to move in the endless loop 428, and when in use, are disposed at the pair of opposing extremes 418 of the endless loop 428.

The ring 420 is rigid and cordless so as to facilitate the ring 420 in moving in the endless loop 428 and for facilitating grasping thereof by the hands, as opposed to a cord which would collapse onto itself.

The endless loop 428 is made from cheesecloth.

The endless loop 428 is made from disposable paper.

The endless loop 428 is made from stockinet which is resiliently stretchable for easy insertion between the toes 12 by virtue of being reduced in width when longitudinally stretched.

The endless loop 428 is made from 100% cotton.

The endless loop 428 is seamless for obviating risk of scarification of the toes 12, which are by nature extremely tender and sensitive, caused by seams, which by nature are relatively hard and abrasive, when the endless loop 428 is moved between the toes 12 during use.

The endless loop 428 is braidless for obviating risk of scarification of the toes 12, which are by nature extremely tender and sensitive, caused by braids, which are by nature relatively hard and abrasive, when the endless loop 428 is moved between the toes 12 during use.

The endless loop 428 is dry for drying the toes 12 so as to prevent formation of athlete's foot and other skin irritations and odors originating from moisture and to aid the handicapped in keeping the toes 12 dry.

The endless loop 428 is impregnated with medicinal powder for preventing at least skin cracking, infection, and fungus.

The endless loop 428 is impregnated with medicinal cream for preventing at least skin cracking, infection, and fungus.

As shown in FIG. 7, the caring device 10 further comprises a package 500.

The package 500 is slender, elongated, and has a pair of ends 504 and an intermediate portion 506 that is disposed intermediate the pair of ends 504 thereof and has opposing ends 505.

The intermediate portion 506 of the package 500 extends the length of, and conformingly captures to prevent movement of, the body 14 therein.

The pair of ends 504 of the package 500 taper away from the opposing ends of the intermediate portion 506 of the package 500, respectively, unto themselves, respectively, and conformingly capture to prevent movement of, the pair of handles 16 therein.

It will be understood that each of the elements described above, or two or more together, may also find a useful application in other types of constructions differing from the types described above.

While the invention has been illustrated and described as embodied in a caring device for toes, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A caring device for toes, comprising:

a) a body for moving longitudinally and simultanously between at least one pair of adjacent toes, and having a length; and b) a pair of handle extending from said body for holding by the hands during use;

wherein said body is slender and elongated for moving longitudinally between one pair of adjacent toes, and has a pair of free ends; wherein said body is flat and formed into endless loop for moving longitudinally and simultaneously between two pair of adjacent toes by capturing and intermediate toe therein, and has a pair of opposing extremes;

wherein each handle is a ring that has said endless loop pass freely therethrough so as to allow each ring to move in said endless loop, and when in use, are disposed at said pair of opposing extremes of said endless loop; and wherein said ring is rigid and cordless so as to facilitate said ring in moving in said endless loop and for facilitating grasping thereof by the hands, as opposed to a cord which would collapse onto itself.

2. The device as defined in claim 1, wherein said body is tubular.

3. The device as defined in claim 1 wherein said body is made from cheesecloth.

4. The device as defined in claim 1, wherein said body is made from disposable paper.

5. The device as defined in claim 1, wherein said body is resiliently stretchable for easy insertion between the toes by virtue of being reduced in width when longitudinally stretched.

6. The device as defined in claim 1, wherein said body is made from 100% cotton.

7. The device as defined in claim 1, wherein said body is seamless for obviating risk of scarification of the toes, which are by nature extremely tender and sensitive, caused by seams, which are by nature relatively hard and abrasive, when said body is moved between the toes during use.

8. The device as defined in claim 1, wherein said, body is braidless for obviating risk of scarification of the toes, which are by nature extremely tender and sensitive, caused by braids, which are by nature relatively hard and abrasive, when said body is moved between the toes during use.

9. The device as defined in claim 1, wherein said body is dry for dry the toes so as to prevent formation of athlete's foot and other skin irritations and odors originating from moisture and to aid handicapped in keeping the toes dry.

10. The device as defined in claim 1, wherein said body is impregnated with medicinal powder for preventing at least skin cracking, infection, and fungus.

11. The device as defined in claim 1, wherein said body is impregnated with medicinal cream for preventing at least skin cracking, infection, and fungus.

12. The device as defined in claim 1, wherein said body is a solid material.

13. The device as defined in claim 1; further comprising a package containing said body and said pair of handles.

14. The device as defined in claim 13, wherein said package is slender, elongated, and has:

a pair of ends; and an intermediate portion that is disposed intermediate said pair of ends thereof and has opposing ends.

15. The device as defined in claim 14, wherein said intermediate portion of said package extends said length of, and conformingly captures to prevent movement of, said body therein.

16. The device as defined in claim 14, wherein said pair of ends of said package taper away from said opposing ends of said intermediate portion of said package, respectively, unto themselves, respectively, and conformingly capture to prevent movement of, said pair of handles therein.

* * * * *